US010937609B1

(12) United States Patent
Chen et al.

(10) Patent No.: US 10,937,609 B1
(45) Date of Patent: Mar. 2, 2021

(54) MEMBRANE CIRCUIT STRUCTURE

(71) Applicant: Primax Electronics Ltd., Taipei (TW)

(72) Inventors: Bo-An Chen, Taipei (TW); Chin-Sung Pan, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 16/662,596

(22) Filed: Oct. 24, 2019

(30) Foreign Application Priority Data

Aug. 30, 2019 (TW) ..... 108131383

(51) Int. Cl.
*H01H 13/70* (2006.01)
*H01H 13/704* (2006.01)

(52) U.S. Cl.
CPC ..... *H01H 13/704* (2013.01); *H01H 2209/026* (2013.01); *H01H 2209/07* (2013.01)

(58) Field of Classification Search
CPC ..... H01H 13/704; H01H 2209/026; H01H 2209/07
USPC ..... 200/5 A, 512
See application file for complete search history.

(56) References Cited

U.S. PATENT DOCUMENTS

2005/0156905 A1* 7/2005 Wang ..... G06F 3/045 345/173
2014/0166455 A1* 6/2014 Chen ..... H01H 13/83 200/5 A
2018/0279470 A1* 9/2018 Chen ..... H05K 1/0298

* cited by examiner

*Primary Examiner* — Edwin A. Leon
*Assistant Examiner* — Iman Malakooti
(74) *Attorney, Agent, or Firm* — Kirton McConkie; Evan R. Witt

(57) ABSTRACT

A membrane circuit structure includes a first film substrate and a first circuit layer. The first circuit layer is disposed on the first film substrate. The first circuit layer contains first conductive silver paste and second conductive silver paste. The first conductive silver paste has a first impedance value. The second conductive silver paste has a second impedance value. The first impedance value is 10 to 15 times the second impedance value.

8 Claims, 3 Drawing Sheets

MEMBRANE CIRCUIT STRUCTURE

FIELD OF THE INVENTION

The present invention relates to an input device, and more particularly to an input device with a membrane circuit structure for a keyboard device.

BACKGROUND OF THE INVENTION

With increasing development of science and technology, a variety of electronic devices are designed in views of convenience and user-friendliness. For helping the user well operate the electronic devices, the electronic devices are gradually developed in views of humanization. The common electronic devices include for example mouse devices, keyboard devices, trackball devices, or the like. Via the keyboard device, characters or symbols can be inputted into the computer system directly. As a consequence, most users and most manufacturers of input devices pay much attention to the development of keyboard devices.

The conventional keyboard device usually comprises a base plate, a membrane circuit board, plural scissors-type connecting elements, plural keycaps and plural elastic elements. The scissors-type connecting element is connected between the base plate and the corresponding keycap. Generally, the membrane circuit board comprises three film layers. From top to bottom, these film layers comprise an upper film layer, an insulating spacer layer and a lower film layer. According to the conventional production technology, circuit patterns are firstly printed on the upper film layer and the lower film layer and then the upper film layer, the insulating spacer layer and the lower film layer are laminated together.

A process of forming the circuit pattern on the upper film layer (or the lower film layer) will be described as follows. Firstly, a silver paste pattern with a lower impedance value is printed on the upper film layer (or the lower film layer). Then, a carbon black pattern with a higher impedance pattern is printed. Consequently, the equivalent impedance value is adjustable, and the function of the circuit pattern to avoid the key ghosting problem is achievable.

However, the conventional method of the forming the circuit pattern still has some drawbacks. For example, since the silver paste pattern and the carbon black pattern are printed in two steps, the silver paste pattern and the carbon black pattern are possibly adsorbed on each other. If the silver paste pattern and the carbon black pattern are adsorbed on each other, the impedance value is abruptly increased. In other words, it is difficult to control the batch printing quality. In addition, the product yield is reduced, and the fabricating cost is increased.

Therefore, there is a need of providing an improved membrane circuit structure in order to overcome the above drawbacks.

SUMMARY OF THE INVENTION

An object of the present invention provides a membrane circuit structure. A circuit layer of the membrane circuit structure is made of conductive silver paste. By adjusting the silver content of the conductive silver paste, the circuit layer contains the conductive silver paste with the higher impedance value and the conductive silver paste with the lower impedance value.

The other objects and advantages of the present invention will be understood from the disclosed technical features.

In accordance with an aspect of the present invention, a membrane circuit structure is provided. The membrane circuit structure includes a first film substrate and a first circuit layer. The first circuit layer is disposed on the first film substrate. The first circuit layer contains first conductive silver paste and second conductive silver paste. The first conductive silver paste has a first impedance value. The second conductive silver paste has a second impedance value. The first impedance value is 10 to 15 times the second impedance value.

In an embodiment, the first impedance value is in a range between 2000 ohms and 6000 ohms, and the second impedance value is in a range between 200 ohms and 450 ohms.

In an embodiment, a silver content of the second conductive silver paste is higher than a silver content of the first conductive silver paste.

In an embodiment, the silver content of the first conductive silver paste is in a range between 38% and 48% by weight, and the silver content of the second conductive silver paste is in a range between 50% and 60% by weight.

In an embodiment, the membrane circuit structure further includes a second film substrate, an insulating spacer substrate and a second circuit layer. The second film substrate is opposed to the first film substrate. The insulating spacer substrate is arranged between the first film substrate and the second film substrate. The second circuit layer is disposed on the second film substrate, and arranged between the second film substrate and the first circuit layer. The second circuit layer contains the first conductive silver paste and the second conductive silver paste.

In an embodiment, the insulating spacer substrate includes at least one opening. When a portion of the first circuit layer and a portion of the second circuit layer are inserted into the corresponding opening and contacted with each other, the first circuit layer and the second circuit layer are electrically connected with each other.

In an embodiment, the first film substrate and the second film substrate are polyester film substrates, and the membrane circuit structure is installed in a keyboard.

In an embodiment, the first circuit layer includes plural main traces and plural outlet traces, which are connected with each other. The first film substrate includes a first zone and a second zone, which are arranged beside each other. The main traces are included in the first zone, and the outlet traces are included in the second zone.

In an embodiment, the main traces and the outlet traces of the first circuit layer are made of the first conductive silver paste, and a bent part at a junction between the main traces and the outlet traces is made of the second conductive silver paste.

In an embodiment, the first circuit layer further includes at least one jump wire that connects two adjacent ones of the plural main traces, and the jump wire is made of the second conductive silver paste.

From the above descriptions, the present invention provides the membrane circuit structure. Each of the first circuit layer and the second circuit layer contains the first conductive silver paste and the second conductive silver paste. The silver content of the first conductive silver paste and the silver content of the second conductive silver paste are different. By adjusting the silver content of the conductive silver paste, the circuit layer contains the conductive silver paste with the higher impedance value and the conductive silver paste with the lower impedance value. Since the silver content of the first conductive silver paste and the silver content of the second conductive silver paste are different and the circuit pattern is specially designed, the key ghosting problem can be avoided. Moreover, since the first circuit layer and the second circuit layer are made of the same conductive material (i.e., the conductive silver paste), the problem of abruptly increasing the impedance value through the adsorption of two conductive materials will be avoided. Since it is easy to control the batch printing quality of the circuit layer of the membrane circuit structure according to the technology of the present invention, the product yield is increased and the fabricating cost is reduced.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
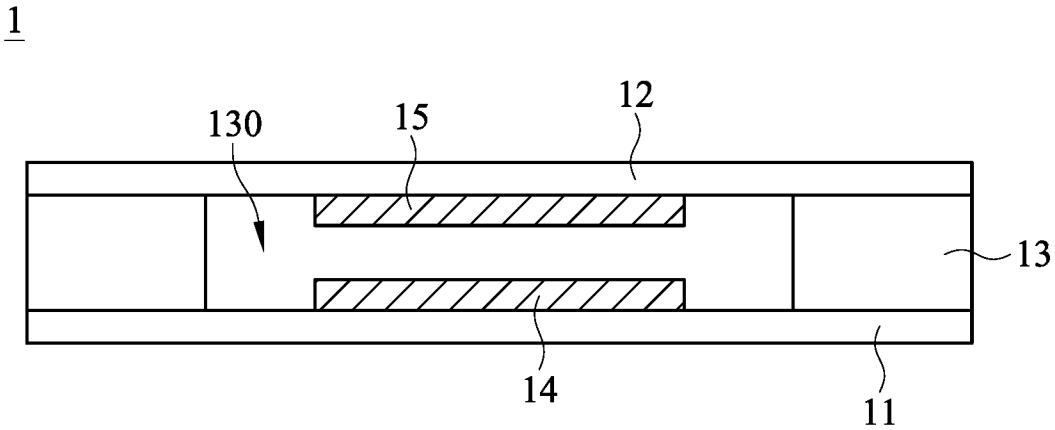
FIG. 1 is a schematic cross-sectional view illustrating a membrane circuit structure according to an embodiment of the present invention.

FIG. 1 is a schematic cross-sectional view illustrating a membrane circuit structure according to an embodiment of the present invention. As shown in FIG. 1, the membrane circuit structure 1 comprises a first film substrate 11, a second film substrate 12, an insulating spacer substrate 13, a first circuit layer 14 and a second circuit layer 15.

The first film substrate 11 and the second film substrate 12 are opposed to each other. The insulating spacer substrate 13 is arranged between the first film substrate 11 and the second film substrate 12. The first circuit layer 14 is disposed on the disposed on the first film substrate 11, and arranged between the first film substrate 11 and the second circuit layer 15. The second circuit layer 15 is disposed on the second film substrate 12, and arranged between the second film substrate 12 and the first circuit layer 14. Each of the first circuit layer 14 and the second circuit layer 15 contains first conductive silver paste and second conductive silver paste. The first conductive silver paste has a first impedance value. The second conductive silver paste has a second impedance value. The first impedance value is 10 to 15 times the second impedance value. For example, the first impedance value is in the range between 2000 ohms and 6000 ohms, and the second impedance value is in the range between 200 ohms and 450 ohms. The magnitudes of the first impedance value and the second impedance value are not restricted as long as the first impedance value is 10 to 15 times the second impedance value. That is, the magnitudes of the first impedance value and the second impedance value may be varied according to the practical requirements.

Preferably but not exclusively, the first film substrate 11 and the second film substrate 12 are polyester (PET) film substrates. Preferably but not exclusively, the first circuit layer 14 and the second circuit layer 15 are respectively printed on the surfaces of the first film substrate 11 and the second film substrate 12 according to the designated circuit patterns.

The membrane circuit structure 1 is installed on an external keyboard of a desktop computer (e.g., a keyboard with a PS2 interface or a keyboard with a USB interface) or a built-in keyboard of a notebook computer or a laptop computer. The applications of the membrane circuit structure 1 are not restricted. That is, the concepts of the membrane circuit structure 1 can be applied to any appropriate electronic product that uses the membrane circuit structure 1 as the signal input interface.

The membrane circuit structure 1 is located under plural key structures (not shown) of the keyboard. Generally, the key structure comprises a keycap, a supporting structure and an elastic element. The connecting relationships between these components are not restricted. Moreover, plural switch circuits are defined by the first circuit layer 14, which is disposed on the disposed on the first film substrate 11. The plural switch circuits are aligned with the corresponding key structures. The membrane circuit structure 1 further comprises plural contact points (not shown). The plural contact points are disposed on the second circuit layer 15, which is disposed on the second film substrate 12. The plural contact points are aligned with the corresponding key structures. These contact points are contactable with the corresponding switch circuits through corresponding openings 130 of the insulating spacer substrate 13.

When the keycap of the key structure is not pressed down, the contact point on the second film substrate 12 and the switch circuit on the first film substrate 11 are separately located at two opposite sides of the insulating spacer substrate 13 and electrically insulated from each other. While the keycap of the key structure is pressed down and moved toward the membrane circuit structure 1, a portion of the second film substrate 12 is pushed into the opening 130 of the insulating spacer substrate 13 by the keycap directly or indirectly. Consequently, the contact point on the second film substrate 12 is penetrated through the opening 130 of the insulating spacer substrate 13. When the contact point on the second film substrate 12 and the switch circuit on the first film substrate 11 are contacted with each other, the switch circuit corresponding to the depressed key structure is triggered to generate a key signal.

In the above embodiment, the membrane circuit structure 1 is a three-layered structure comprising the first film substrate 11, the second film substrate 12 and the insulating spacer substrate 13. The circuit layer contains the first conductive silver paste with the higher impedance value and the second conductive silver paste with the lower impedance value. It is noted that numerous modifications and alterations may be made while retaining the teachings of the invention. For example, in another embodiment, the membrane circuit structure has a two-layered structure, a folded structure or a single-layered structure.

The conductive silver paste of the membrane circuit structure 1 will be described as follows.

In this embodiment, each of the first circuit layer 14 and the second circuit layer 15 contains the first conductive silver paste and the second conductive silver paste. The silver content of the first conductive silver paste and the silver content of the second conductive silver paste are different. Moreover, the silver content of the second conductive silver paste is higher than the silver content of the first conductive silver paste. That is, both of the first circuit layer 14 and the second circuit layer 15 contain the conductive silver paste, and the first conductive silver paste with the higher impedance value (i.e., the first impedance value) and the second conductive silver paste with the lower impedance value (i.e., the second impedance value) are obtained by adjusting the silver content of the conductive silver paste. As mentioned above, the first impedance value of the first conductive silver paste is 10 to 15 times the second impedance value of the second conductive silver paste. For achieving this purpose, the silver content of the first conductive silver paste is in the range between 38% and 48% by weight, and the silver content of the second conductive silver paste is in the range between 50% and 60% by weight. Since the silver content of the first conductive silver paste and the silver content of the second conductive silver paste are different and the circuit pattern is specially designed, the key ghosting problem can be avoided.

It is noted that the silver content of the first conductive silver paste and the silver content of the second conductive silver paste may be varied according to the practical requirements. In a preferred embodiment, the silver content of the first conductive silver paste is in the range between 40% and 44% by weight, and the silver content of the second conductive silver paste is in the range between 54% and 56% by weight.

Figure 2:
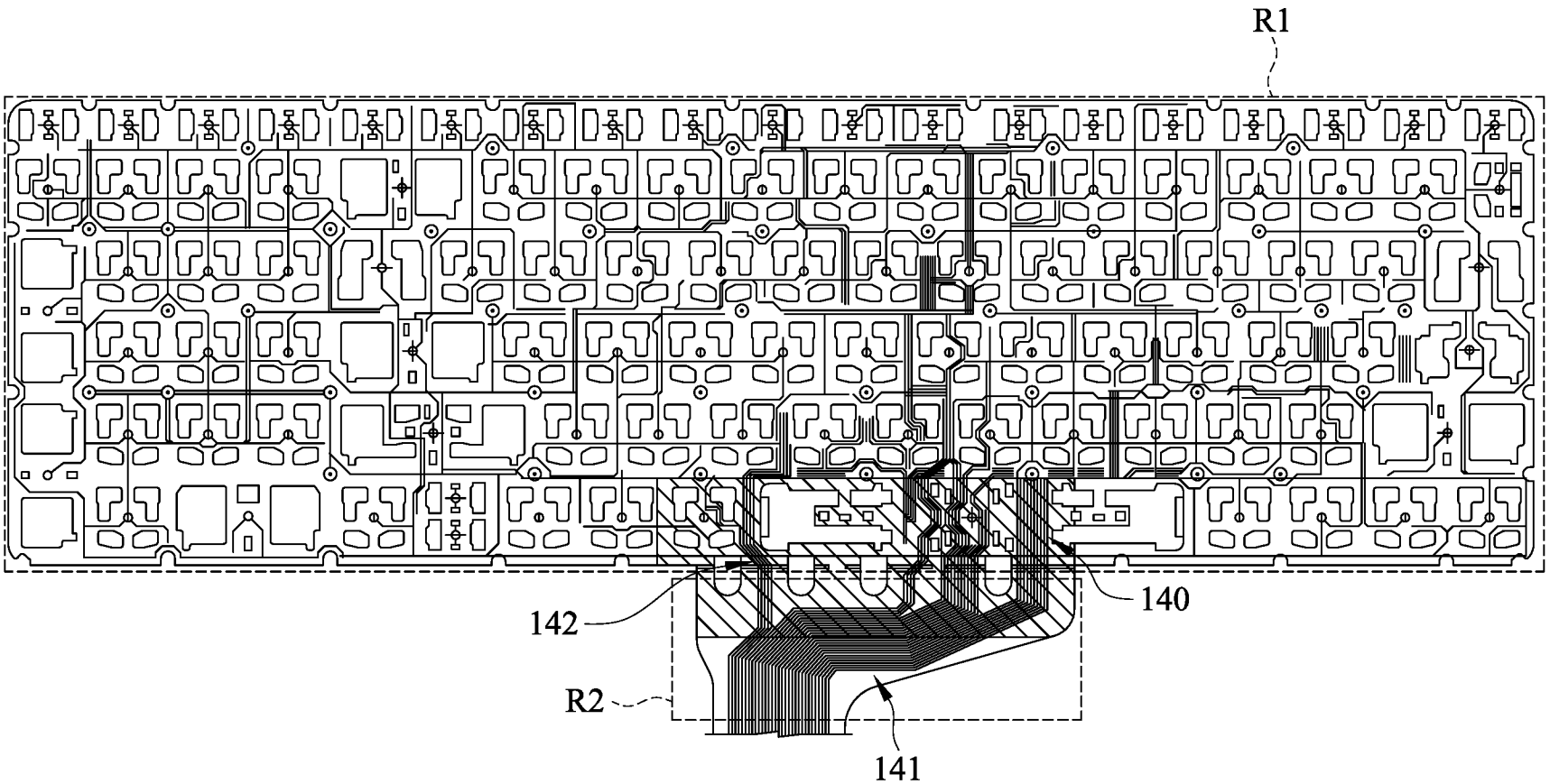
FIG. 2 schematically illustrates the circuit pattern of the membrane circuit structure as shown in FIG. 1 and applied to a keyboard.
Figure 3:
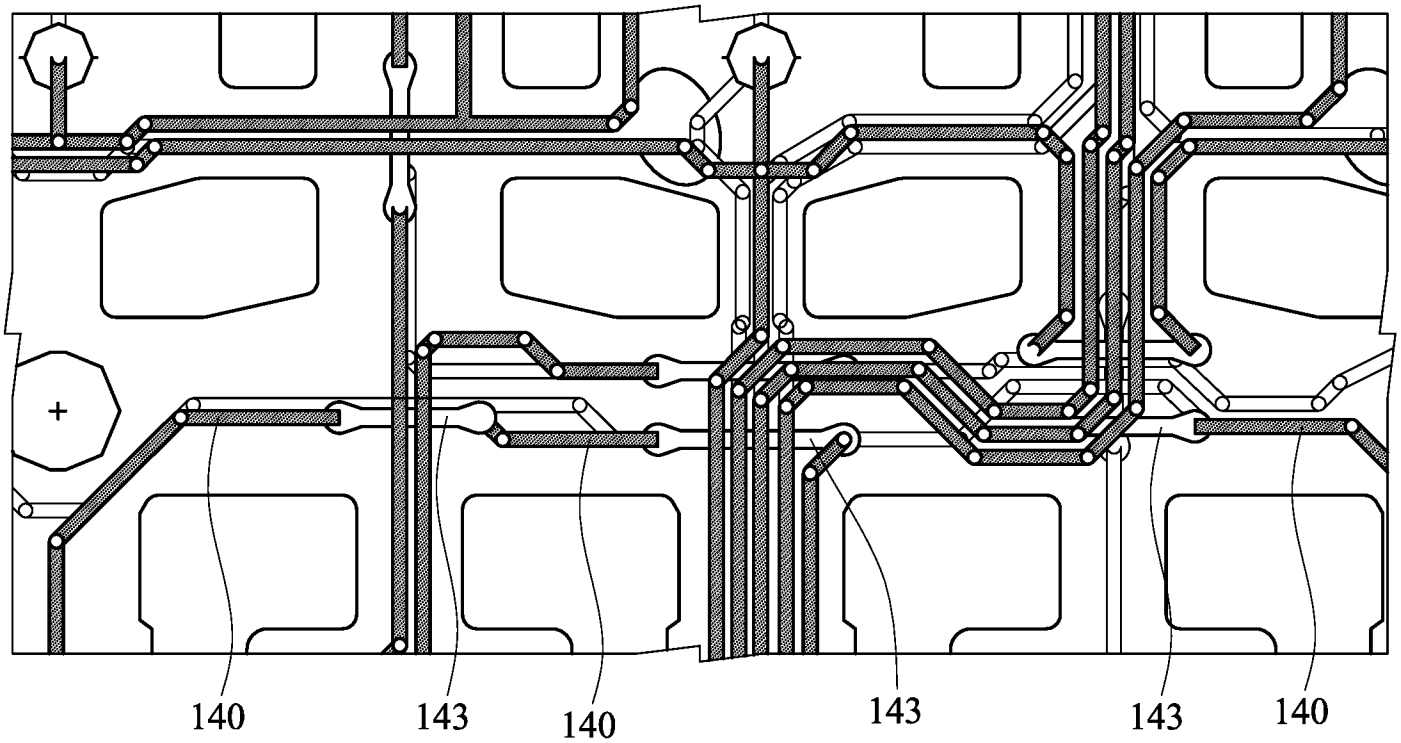
FIG. 3 schematic enlarged view illustrates some jump wires of the circuit pattern as shown in FIG. 2.

Please refer to FIGS. 2 and 3. FIG. 2 schematically illustrates the circuit pattern of the membrane circuit structure as shown in FIG. 1 and applied to a keyboard. FIG. 3 schematic enlarged view illustrates some jump wires of the circuit pattern as shown in FIG. 2. In FIG. 2, the extension structure of the membrane circuit structure 1 of FIG. 1 is shown. Moreover, the circuit pattern as shown in FIGS. 2 and 3 is the circuit pattern of the first circuit layer 14 that is printed on the first film substrate 11. That is, FIGS. 2 and 3 are schematic top views of the first circuit layer 14.

Please refer to FIGS. 2 and 3. The first circuit layer 14 of the membrane circuit structure 1 comprises main traces 140 and outlet traces 141, which are connected with each other. The first film substrate 11 comprises a first zone R1 and a second zone R2. The second zone R2 is arranged beside the first zone R1. The first zone R1 is aligned with the plural key structures of the keyboard, and the second zone R2 is not aligned with the key structures. The main traces 140 of the first circuit layer 14 are included in the first zone R1 of the first film substrate 11. The outlet traces 141 of the first circuit layer 14 are included in the second zone R2. The main traces 140 and the outlet traces 141 of the first circuit layer 14 are made of the first conductive silver paste. That is, the main traces 140 and the outlet traces 141 have the higher impedance value (e.g., in the range between 2000 ohms and 6000 ohms). In addition, a bent part 142 at a junction between the main traces 140 and the outlet traces 141 is made of the second conductive silver paste. That is, the bent part 142 is made of the lower impedance value (e.g., in the range between 200 ohms and 450 ohms). The first circuit layer 14 further comprises at least one jump wire 143 for connecting two adjacent main traces 140. The jump wire 143 is made of the second conductive silver paste. That is, the jump wire 143 is made of the lower impedance value (e.g., in the range between 200 ohms and 450 ohms). The circuit pattern of the second circuit layer 15 is similar to that of the first circuit layer 14, and is not redundantly described herein.

As mentioned above, most traces (i.e., the main traces 140 and the outlet traces 141) of the first circuit layer 14 (or the second circuit layer 15) are made of the first conductive silver paste with the higher impedance value. In addition, the bent part 142 at the junction between the main traces 140 and the outlet traces 141 and the jump wire 143 for connecting two adjacent main traces 140 are made of the second conductive silver paste with the lower impedance value. That is, a greater portion of the circuit layer of the membrane circuit structure 1 is made of the first conductive silver paste with the higher impedance value, and a smaller portion of the circuit layer of the membrane circuit structure 1 is made of second conductive silver paste with the lower impedance value. Consequently, the desired impedance value can be adjusted. As previously described, the conventional circuit pattern uses the silver paste pattern with the lower impedance value and the carbon black pattern with the higher impedance value to adjust the impedance value. In comparison with the conventional technology, the product yield of the membrane circuit structure of the present invention is increased and the fabricating cost is reduced.

From the above descriptions, the present invention provides the membrane circuit structure. Each of the first circuit layer and the second circuit layer contains the first conductive silver paste and the second conductive silver paste. The silver content of the first conductive silver paste and the silver content of the second conductive silver paste are different. By adjusting the silver content of the conductive silver paste, the circuit layer contains the conductive silver paste with the higher impedance value and the conductive silver paste with the lower impedance value. Since the silver content of the first conductive silver paste and the silver content of the second conductive silver paste are different and the circuit pattern is specially designed, the key ghosting problem can be avoided. Moreover, since the first circuit layer and the second circuit layer are made of the same conductive material (i.e., the conductive silver paste), the problem of abruptly increasing the impedance value through the adsorption of two conductive materials will be avoided. Since it is easy to control the batch printing quality of the circuit layer of the membrane circuit structure according to the technology of the present invention, the product yield is increased and the fabricating cost is reduced.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A membrane circuit structure, comprising:

a first film substrate; and a first circuit layer disposed on the first film substrate, and containing first conductive silver paste and second conductive silver paste, wherein the first conductive silver paste has a first impedance value, and the second conductive silver paste has a second impedance value, wherein the first impedance value is 10 to 15 times the second impedance value to avoid key ghosting, wherein the first circuit layer comprises plural main traces and plural outlet traces, which are connected with each other, wherein the first film substrate comprises a first zone and a second zone, which are arranged beside each other, wherein the main traces are included in the first zone, and the outlet traces are included in the second zone, and wherein the main traces and the outlet traces of the first circuit layer are made of the first conductive silver paste, and a bent part at a junction between the main traces and the outlet traces is made of the second conductive silver paste.

2. The membrane circuit structure according to claim 1, wherein the first impedance value is in a range between 2000 ohms and 6000 ohms, and the second impedance value is in a range between 200 ohms and 450 ohms.

3. The membrane circuit structure according to claim 1, wherein a silver content of the second conductive silver paste is higher than a silver content of the first conductive silver paste.

4. The membrane circuit structure according to claim 3, wherein the silver content of the first conductive silver paste is in a range between 38% and 48% by weight, and the silver content of the second conductive silver paste is in a range between 50% and 60% by weight.

5. The membrane circuit structure according to claim 1, further comprising:

a second film substrate opposed to the first film substrate;

an insulating spacer substrate arranged between the first film substrate and the second film substrate; and a second circuit layer disposed on the second film substrate, and arranged between the second film substrate and the first circuit layer, wherein the second circuit layer contains the first conductive silver paste and the second conductive silver paste.

6. The membrane circuit structure according to claim 5, wherein the insulating spacer substrate comprises at least one opening, wherein when a portion of the first circuit layer and a portion of the second circuit layer are inserted into the corresponding opening and contacted with each other, the first circuit layer and the second circuit layer are electrically connected with each other.

7. The membrane circuit structure according to claim 5, wherein the first film substrate and the second film substrate are polyester film substrates, and the membrane circuit structure is installed in a keyboard.

8. The membrane circuit structure according to claim 1, wherein the first circuit layer further comprises at least one jump wire that connects two adjacent ones of the plural main traces, and the jump wire is made of the second conductive silver paste.

* * * * *